US005226289A

United States Patent [19]

Krebs

[11] Patent Number: 5,226,289

[45] Date of Patent: Jul. 13, 1993

[54] CONTROL SYSTEM FOR AUTOMATICALLY REGULATING THE DISPLACEMENT SETTING OF A PLURALITY OF HYDROSTATIC PUMPS

[75] Inventor: Clemens Krebs, Tubingen, Fed. Rep. of Germany

[73] Assignee: Brueninghaus Hydraulik GmbH, Horb, Fed. Rep. of Germany

[21] Appl. No.: 744,431

[22] Filed: Aug. 13, 1991

[30] Foreign Application Priority Data

Aug. 13, 1990 [DE] Fed. Rep. of Germany ..... 4025638

[51] Int. Cl.[5] ..... F16D 31/02

[52] U.S. Cl. ..... 60/430; 60/450

[58] Field of Search ..... 60/428, 430, 450, 452, 60/486

[56] References Cited

U.S. PATENT DOCUMENTS

| | | | |
|---|---|---|---|
| 4,123,202 | 10/1978 | James et al. | 60/450 |
| 4,495,766 | 1/1985 | Krusche | 60/428 |
| 4,745,747 | 5/1988 | Krausse et al. | 60/452 |
| 4,813,235 | 3/1989 | Miller | 60/452 |
| 4,949,541 | 8/1990 | de Vietro | 60/452 |

*Primary Examiner*—Edward K. Look
*Assistant Examiner*—F. Daniel Lopez
*Attorney, Agent, or Firm*—Scully, Scott, Murphy & Presser

[57] ABSTRACT

The invention relates to a control system for automatically regulating the displacement setting of a plurality of variable-displacement hydrostatic pumps that are connected in parallel, each via a respective working pressure line, to a common consumer line and are each connected to a respective adjusting device that can be acted on by an adjusting pressure, each of said adjusting device having associated with it a pilot valve that is acted on towards a regulating position, against a counter-pressure, by a first control pressure corresponding to the pressure in the working pressure line of the respective pump and by a second control pressure corresponding to the displacement setting of the associated pump, and which in the control position regulates the setting pressure acting on the adjusting device to reduce the displacement of the associated pump. To reduce the constructional outlay and to enable the individual pumps to be regulated to the same actually required outputs despite disturbing factors, according to the invention said second control pressure ($p_{Qi}$) is taken off before a throttle in the working pressure line of the respective pump and acts on the associated pilot valve via a control pressure line towards the control position.

8 Claims, 4 Drawing Sheets

CONTROL SYSTEM FOR AUTOMATICALLY REGULATING THE DISPLACEMENT SETTING OF A PLURALITY OF HYDROSTATIC PUMPS

TECHNICAL FIELD OF THE INVENTION

The invention relates to a control system for automatically regulating the displacement setting of a plurality of hydrostatic pumps arranged in parallel and connected to a common consumer.

BACKGROUND OF THE INVENTION AND PRIOR ART

A control system of this kind is known from German patent 37 11 049 in which each individual pump has associated with it a measuring and control unit comprising a pressure limiting valve, a position detector and a line incorporating a throttle. This line connects the inlet of the pressure limiting valve with a control pressure line connected to the working pressure line of the respective pump and leads to a spring chamber of the pilot valve, which is in the form of a 3/2-way valve. A spring in the spring chamber produces the counter-pressure that is opposed by the working pressure prevailing in the working pressure line and in the consumer line as a first control pressure. The position detector comprises an inclined surface formed on the piston rod of the adjusting piston of the adjusting cylinder and a feeler pin that is held against the oblique face by a spring, through which it acts on the spool of the pressure limiting valve. If the associated pump is adjusted to zero displacement the pressure limiting valve is closed, producing a correspondingly large second control pressure. Increasing the tilting-out of the pump leads to a magnified response corresponding to the movement of the oblique face, reducing the second control pressure.

As the displacement of the pump decreases the thus-controlled second control pressure in the spring chamber of the pilot valve increases the pressure difference between the first and second control pressures that acts against the counter-pressure as the intended value of the control variable. This results in a p-Q control characteristic that rises as the pump displacement decreases and deviates from the intended value that corresponds to the constant counter-pressure by the so-called residual intended pressure deviation. Such pressure-regulated pumps exhibit so-called proportional behaviour and consequently, inter alia, the advantage that with the same setting of the counter-pressure, despite different starting positions, they can be regulated to the same displacement setting, i.e. in the case for example of axial piston machines to the same tilt angle, provided their adjusting means have the same adjusting characteristic. However, despite their displacement settings being the same, the actual output of the individual pumps may be different because of disturbing factors such as, for example, different pump rotating speeds, different constructional tolerances, different frictional and internal forces, and also differing adjusting characteristics of the adjusting means, etc. A further disadvantage of the known control system is the high constructional outlay on the measuring and control units needed to generate the second control pressure.

OBJECT OF THE INVENTION

It is an object of the invention to improve a control system of the kind referred to so as to make it possible, with less constructional outlay, to control the individual pumps automatically, despite disturbing factors, so that their actual output is the same.

SUMMARY OF THE INVENTION

In contrast to the prior art, instead of the displacement setting of each pump (tilt angle in the case of axial piston pumps), according to the invention the actual output of each pump is detected by the throttle associated with it, the pressure drop at this throttle being combined functionally with the first control pressure (the system pressure after the throttle) to give the second control pressure. This second control pressure is the sole control pressure acting on the pilot valve associated with the respective adjusting pump towards the control position.

Since the system pressure respectively required, for example in the case when the output of one of the adjusting pumps is too small, is automatically maintained by a corresponding increase in the output of the other, parallel-connected pumps, it is not necessary to take any constructive account of the first control pressure in the action on the pilot valve. Thus the second control pressure takes the place of the pressure difference at the respective throttle as a measure of the output actually required from the associated pump, so that the automatic control, which is constructionally a pressure control, is functionally a flow control.

Since over the whole operating range the pressure losses at the throttles decrease as the output decreases, so that the system pressure increases relative to the second control pressure, the result is likewise a rising p-Q characteristic for the whole set of pumps and thus a proportional regulation.

Differences between the actual outputs of the individual pumps are detected by the throttle losses, or in place of these by the second control pressures, and compensated by means of these pressures by correction of the displacement setting of the pumps until their output is equalised. This even makes it possible to operate variable displacement pumps of different sizes so that they deliver equal outputs into the common consumer line. Compared with the measuring and control units used according to the prior art, the throttles that have to be used in order to obtain this advantage involve only a negligible constructional outlay.

The counter-pressure may be a spring pressure and/or a hydraulic pressure, and if desired may be adjustable Advantageously a remote control valve, common to all the pilot valves, is provided to control the hydraulic counter-pressure. This makes it possible to apply the same counter-pressure to all the pilot valves, and thereby to achieve the highest precision in correcting the displacement adjustment to produce equal outputs.

According to another aspect of the invention the remote control valve is in the form of a pressure limiting valve connected to a counter-pressure control chamber and also, via a throttle, to the control pressure line of each pilot valve. Apart from the advantage of producing the highest precision in the displacement adjustment it is possible, by changing the response behaviour (spring pressure and spring characteristic) of the pressure-limiting valve, to displace the p-Q characteristic for the totality of the parallel-connected pumps in any desired manner, or even to change its shape. For the individual pumps this displacement or change of shape can be effected by adjustment of the counter-pressure at the respective pilot valve or by changing the throttle characteristic and the through-flow cross-section of the respective throttle.

The same advantages can also be achieved if the remote control valve is in the form of a throttle element arranged in the consumer line, preferably in the form of an adjustable throttle valve, behind which a branch line leads to the counter-pressure control chamber of each pilot valve. Using this remote control valve the control system of the invention is not only functionally but also constructionally flow-controlled.

BRIEF DESCRIPTION OF THE DRAWINGS

The invention will now be described in more detail, by way of example, with reference to three preferred embodiments shown in the drawings, in which.

DETAILED DESCRIPTION OF PREFERRED EMBODIMENTS OF THE INVENTION

Figure 1:
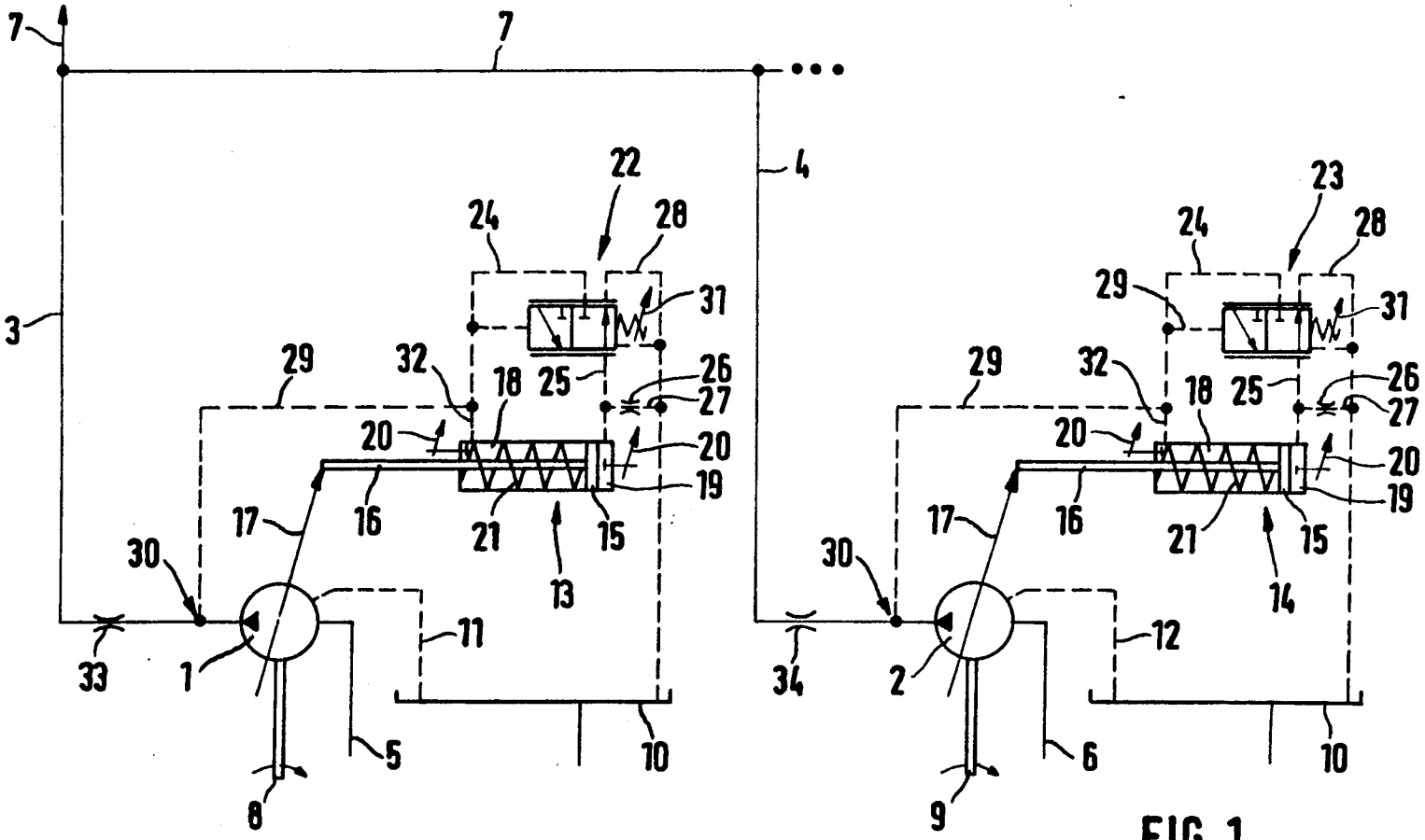
FIG. 1 is a circuit diagram of a control system according to the first preferred embodiment of the invention, with direct pressure control (in terms of construction)

FIG. 1 shows two or more variable-displacement hydrostatic pumps 1, 2 with a single direction of flow that are connected in parallel via respective working pressure lines 3, 4 and suction lines 5, 6 to a common consumer line 7 and/or to the tank 10. The consumer line 7 leads to at least one consumer unit (not shown). The two pumps 1, 2 are driven through respective drive shafts 8, 9 by a common driving motor or individual driving motors (not shown) and discharge their leakage oil via respective leakage lines 11, 12 to the tank 10. In the case of a closed circuit hydraulic drive the suction lines 5, 6 may be connected to a common return line leading to the consumer unit instead of to the tank 10.

Each of the pumps 1, 2 has associated with it an adjusting means in the form of a hydraulic adjusting cylinder 13, 14 to adjust its displacement. In each of the adjusting cylinders 13, 14 there is a displaceable adjusting piston 15, connected by a piston rod 16 to the setting member 17 of the respective variable-displacement pump 1, 2. In each of the adjusting cylinders 13, 14 the (smaller) annular piston surface of the adjusting piston 15 bounds a left-hand cylinder chamber 18 and the (larger) piston surface bounds a right-hand cylinder chamber 19. In each of the cylinder chambers 18, 19 there is an adjustable stop 20 to limit the stroke of the adjusting piston 15. A compression spring 21 in the left-hand cylinder chamber 18 acts on the adjusting piston 15, tending to reduce the size of the right-hand cylinder chamber 19 and thus tilt the pump 1, 2 outwards to greater displacement. The cylinder chambers 18, 19 can be acted on by a setting pressure via respective connections.

The regulation of the setting pressure acting on each of the adjusting cylinders 13, 14 takes place via respective pilot valves 22, 23 each having the form of a continuously adjustable 3/2-way spool valve with a connection to a first setting-pressure branch line 24 and to a second setting-pressure branch line 25. The latter line leads to the right-hand cylinder chamber 19 of the associated adjusting cylinder 13 or 14 and is also connected via a connecting line having a throttle section 26 therein to a tank-connecting line 28 leading from the pilot valve 22 or 23 to the tank 10.

The first setting-pressure branch line 24 leads to a control pressure line 29 that branches from the respective associated working pressure line 3 or 4 at a junction 30. Via this control pressure line 29 the spool of the respective pilot valve 22 or 23 is urged towards the control position against the counter-pressure $p_G$ of a spring 31 arranged in a spring chamber. A section 32 of the setting-pressure line leads from the control pressure line 29 to connect with the left-hand cylinder chamber 18 of the associated adjusting cylinder 13 or 14 respectively. Each of the pilot valves 22, 23 represents constructionally a directly-controlled pressure control valve. Each of the spring chambers is connected for relief to the tank-connection line.

In the working pressure line 3, 4 of each of the pumps 1, 2 a respective constant throttle 33, 34 is connected between the junction 30 and the consumer line 7 and represents, together with the respective associated pilot valve 22 or 23 a pressure control unit. The totality of the pressure control units make up the control system according to the invention, which functions as follows:

The pumps 1, 2 driven by the drive motor(s) produce outputs Qi which flow through the working pressure lines 3, 4 into the consumer line 7 and are there united to form a combined output Qges that is under a system pressure $p_{Qges}$. At the same time there is set up at the outlet of each of the pumps 1, 2, i.e. before the respective constant throttle 33 or 34, a pump pressure $p_{Qi}$ which is higher than the pressure behind the throttle, i.e. the system pressure $p_{Qges}$, by the pressure drop $\Delta p$ at this throttle, and which acts on the respective pilot valve 22 or 23 via the associated control pressure line 29.

So long as the hydraulic force of this pump pressure $p_{Qi}$ is less than the spring force of the preset counter-pressure $p_G$ (intended value of the control variable) the pilot valve 22 or 23 remains in the rest position shown in FIG. 1, wherein the right-hand cylinder chamber 19 of the adjusting cylinder 13 or 14 is connected to the tank-connecting line 28 leading to the tank 10 and the adjusting piston 15 is displaced by the spring 21 and the prevailing working pressure in the left-hand cylinder chamber 18 up to the stop 20 in the right-hand cylinder chamber 19, so that the pump 1 or 2 is tilted out to its maximum displacement.

As soon as the hydraulic force of the pump pressure $p_{Qi}$ exceeds the spring pressure, it displaces the spool of the pilot valve 22 or 23 to the right into the control position in which the pump pressure acts as a setting pressure on the larger piston face in the right-hand cylinder chamber 19 of the adjusting cylinder 13 or 14 and displaces the adjusting piston 15 to the left, thus tilting back the adjusting pump 1 or 2, until the forces acting on the pilot valve 22 or 23 are in equilibrium. The outputs Qi of the tilted-back pumps 1, 2 produce in the consumer line 7 the combined output Qges, under the system pressure $p_{Qges}$, that is required by the consumer unit.

Figure 4:
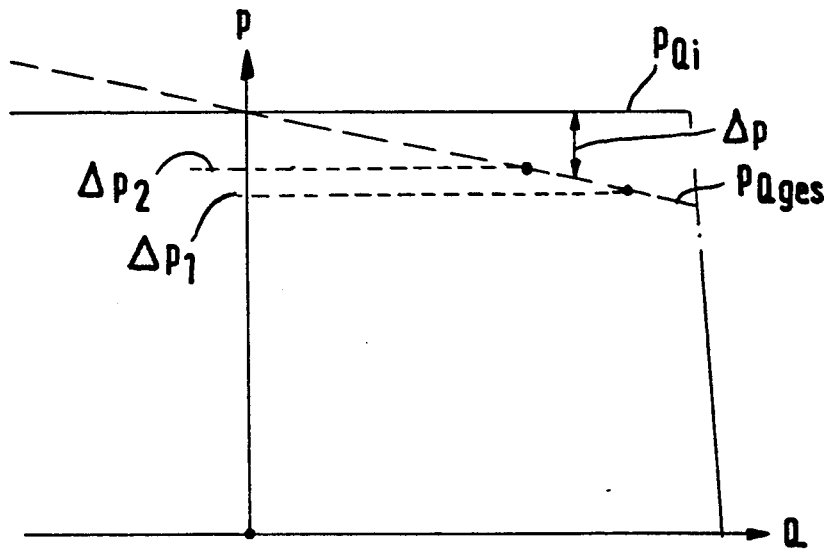
FIG. 4 is a p-Q diagram.

There is thus set up at the outlet of each of the pumps 1, 2 a maximum pump pressure $p_{Qi}$ that is greater than the system pressure $p_{Qges}$ by the pressure difference $\Delta p$ produced by the respective constant throttle 33 or 34 and corresponds to the preset counter-pressure $p_G$ or intended value of the control variable. During operation the two pumps 1, 2 are constantly regulated to this intended value of the pump pressure $p_{Qi}$, and thereby the corresponding system pressure $p_{Qges}$. The associated characteristics are shown in the p-Q diagram in FIG. 4. While the pump pressure characteristic $p_{Qi}$ runs parallel to the x-axis, the system pressure characteristic $p_{Qges}$ is a straight line that rises with falling displacement setting of the displacement pumps 1, 2, and thus with falling pressure difference $\Delta p$ at the constant throttles 33, 34, and intersects the pump pressure characteristic $p_{Qi}$ at zero displacement. The difference in the ordinates of the two characteristics at this operating point represents the current pressure difference $\Delta p$. It will be seen that the pump or second control pressure $p_{Qi}$ obtaining in the respective control pressure line 29 is made up mathematically of two components, namely the system pressure $p_{Qges}$ as the first control pressure and the pressure difference $\Delta p$.

Because of the use of constant throttles 33, 34 with the same throttle characteristics and the presetting of the counter-pressure $p_G$ at the two pilot valves 22, 23 to the same value, the two variable-displacement pumps 1, 2 are set to the same displacement and in the ideal case deliver the same output; thus they follow the same characteristic $p_{Qi}$ or $p_{Qges}$. Deviations from the ideal case, which in practice are almost unavoidable, are corrected by the control system according to the invention in the following manner.

Outputs that are different, for example as a result of differences between the displacement settings of the pumps 1, 2, produce different pressure differences $\Delta p$ at the constant throttles 33, 34. Since the system pressure $p_{Qges}$ (first control pressure) in the consumer line 7 is the same for the two pumps 1, 2, different pump pressures $p_{Qi}$ result at the outlets of the two pumps 1, 2, which act as second control pressures on the pilot valves 22, 23 through the control pressure lines 29. Consequently the pump with the greater output and thus the higher pump pressure $p_{Qi}$ or greater pressure difference $\Delta p_1$ is tilted back in the direction of smaller displacement and the pump with the smaller output and thus the lower pump pressure $p_{Qi}$ or smaller pressure difference $\Delta p_2$ is tilted out towards maximum displacement, until the outputs produced by the two pumps 1, 2, and thus the pump pressures $p_{Qi}$ or pressure differences $\Delta p$, are the same, without any change in the total output or the system pressure $p_{Qges}$.

Figure 2:
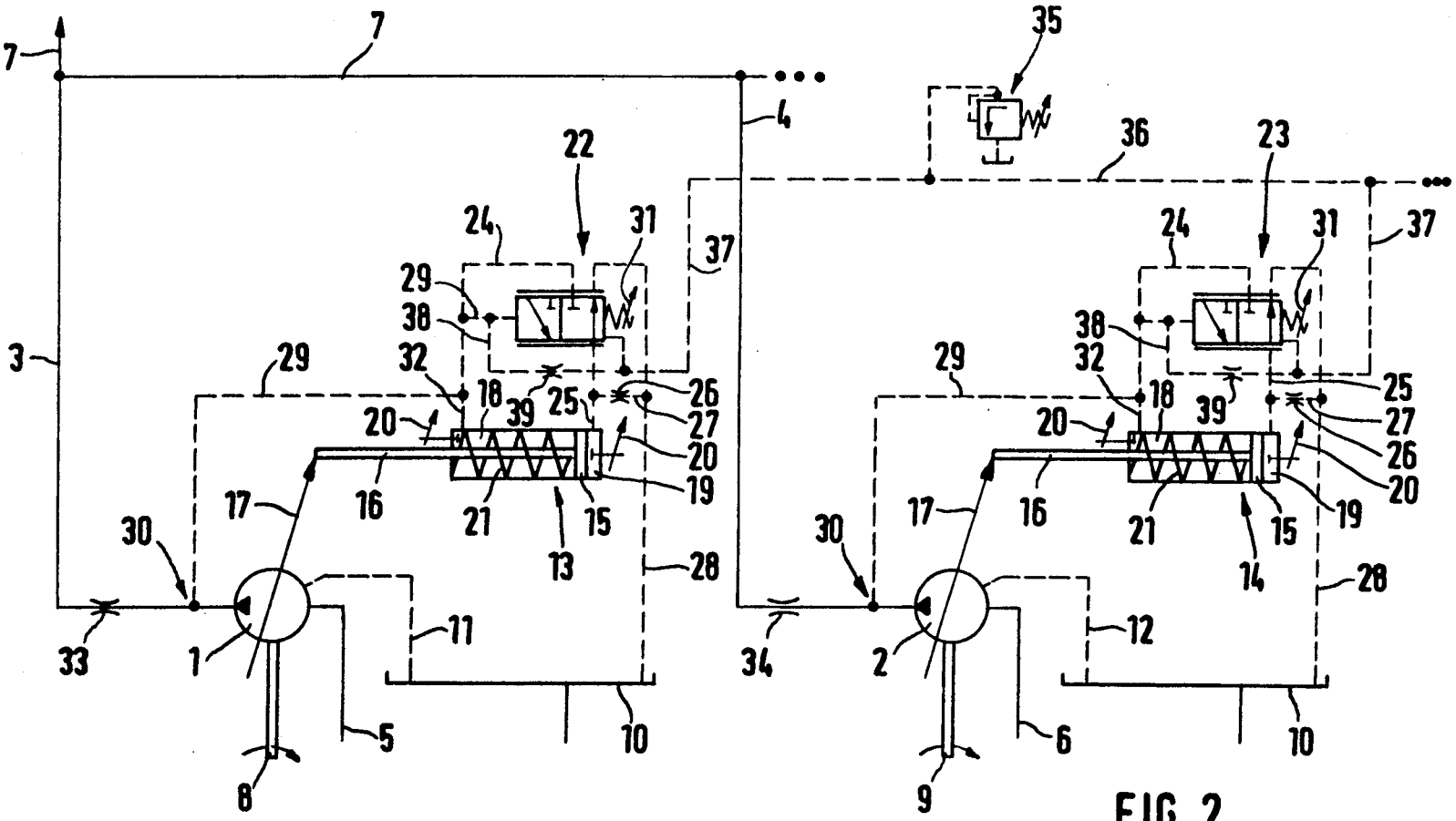
FIG. 2 is a circuit diagram of a control system according to the second preferred embodiment of the invention with remote-controlled pressure control (in terms of construction)

The control system shown in FIG. 2 is provided with a remote-controlled pressure control means (from the point of view of construction), but is otherwise identical with the control system shown in FIG. 1.

The remote-controlled pressure control means comprises a remote control valve in the form of a pressure limiting valve 35 that is connected via a remote control line 36 and respective remote control branch lines 37 branching therefrom to the spring chamber of each of the pilot valves 22 or 23 and via a continuing line 38 having a throttle 39 therein to the control pressure line 29 leading to the same pilot valve 22 or 23.

When the pumps 1, 2 are being driven and the pressure limiting valve 35 is closed, the pump pressure $p_{Qi}$ at the outlet of each of the pumps 1, 2 is transmitted into the respective associated remote control branch line 37 and the remote control line 36 and is applied in the spring chamber of the respective pilot valve 22 or 23. Here it makes up, together with the present spring pressure, the counter-pressure $p_G$ and counteracts the effect of the pump pressure $p_{Qi}$ on the respective pilot valve 22 or 23. Consequently the two pilot valves 22, 23 remain in the rest position under the spring pressure alone until the pump pressure $p_{Qi}$ at the outlet of one or both of the pumps 1, 2 opens the pressure limiting valve 35 when a maximum value preset in it is exceeded and opens the throughflow to the tank 10. The pressure difference that then results at the throttle 39 associated with the pump 1 or 2 displaces the spool of the respective pilot valve 22 or 23 associated therewith to the right against the spring pressure into the position, so that the respective pump 1 or 2 is tilted back in the manner already described until the forces acting at the respective pilot valve 22 or 23 are in equilibrium. The regulation of the two pumps 1, 2 to the same output takes place in the same way as with the directly-controlled pressure control means shown in FIG. 1, namely by means of the second control pressure $p_{Qi}$ and the system pressure characteristic that rises with decreasing displacement setting.

Figure 3:
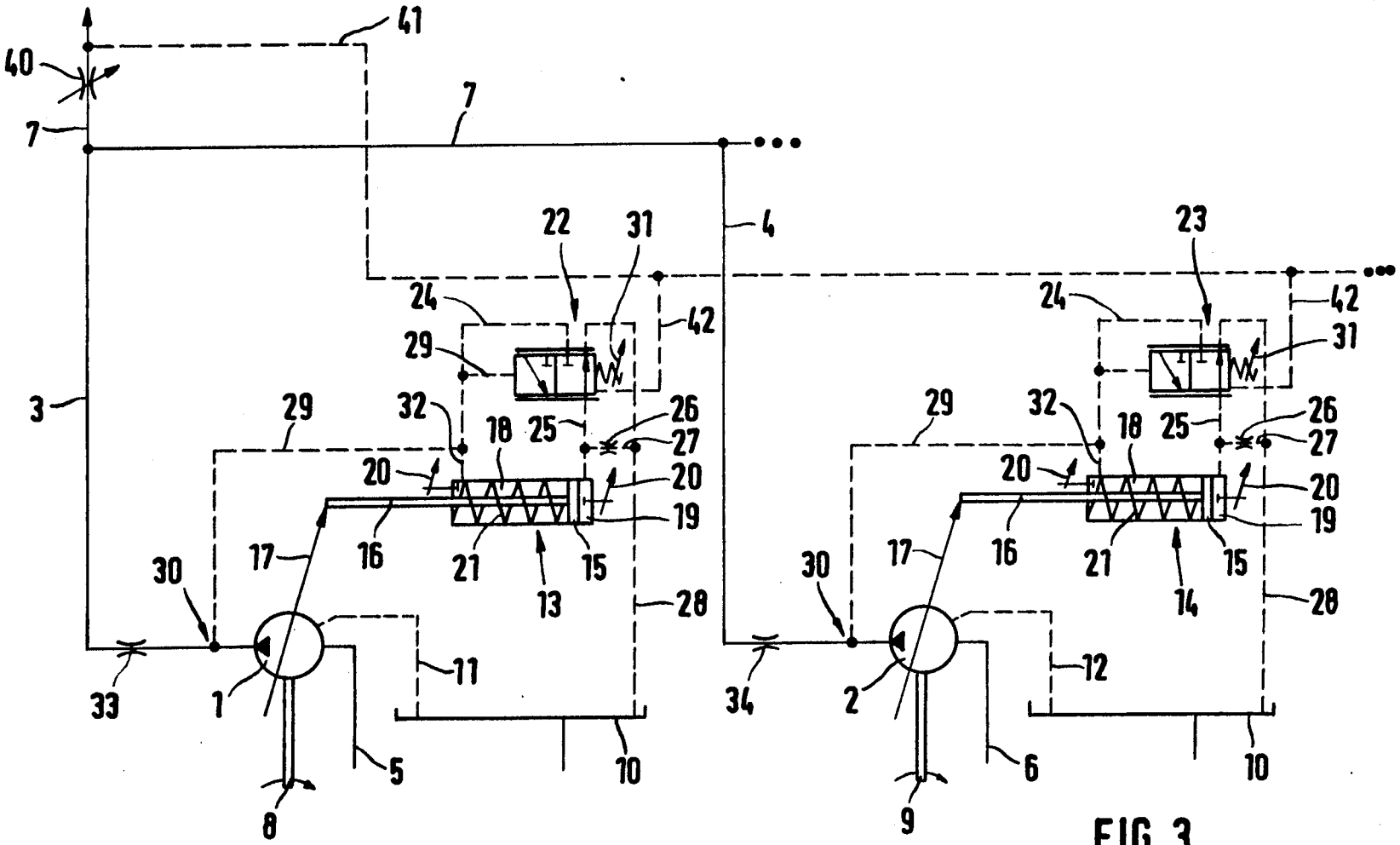
FIG. 3 is a circuit diagram of a control system according to the third preferred embodiment of the invention with flow control (in terms of construction)

The control system shown in FIG. 3 is provided with a flow control means (from the point of view of construction), but is otherwise identical with the control system shown in FIG. 1.

The flow control means comprises a remote control valve, in the form of an adjustable throttle valve 40, arranged in the consumer line 7, and a branch line 41 that branches off after the adjustable throttle valve 40 (in the direction of flow) and leads via sub-branch lines 42 to the spring chamber of each of the pilot valves 22, 23.

In operation, each of the pilot valves 22, 23 is acted on towards the control position by the pump pressure $p_{Qi}$ prevailing in the associated control pressure line 29 and towards the rest position by the counter-pressure $p_G$, made up of the sum of the spring pressure and the system pressure $p_{Qges}$ in the branch line 41 and the associated sub-branch line 42. In this way each of the pilot valves 22, 23 is acted on against the spring pressure by a pressure difference $\Delta p$ made up of the total pressure drop produced by the respective associated constant throttle 33 or 34, depending on the output Qi of the associated pump 1 or 2 and by the adjustable throttle 40, depending on the total output $p_{Qges}$. Since this pressure difference $\Delta p$ becomes smaller as the displacement decreases, the result is a flow control means having a system characteristic $p_{Qges}$ which, like the pressure control unit shown in FIGS. 1 and 2, exhibits proportional behaviour and enables the pumps 1, 2 to be regulated to the same output. By adjustment of the adjustable throttle valve 40 the pilot valves 22, 23 can be caused to take up their control position in the case of a greater or lesser total output $Q_{pges}$, i.e. the counter-pressure $p_G$ as the intended value for the control variable is changed to the same extent for all the pilot valves 22, 23, so that the system pressure characteristic $p_{Qges}$ is displaced. A change in the throttle characteristic or in the throughflow characteristic of the adjustable throttle 40 brings about a change in the shape of the system pressure characteristic $p_{Qges}$.

What is claimed is:

1. A control system for automatically regulating the displacement setting of a plurality of variable-displacement hydrostatic pumps connected in parallel, each via a working pressure line, to a consumer line that leads to at least one common consumer, and operating simultaneously to generate a flow of pressurized fluid having the same pressure in the consumer line, each pump being further connected to a respective adjusting means that can be subjected to a setting pressure to adjust their displacement, each of said adjusting means having associated with it a pilot valve which is acted on towards a control position against a counter-pressure by a single control pressure ($p_{Qi}$) having a magnitude varying with the displacement setting of the associated pump, and which in the control position regulates the setting pressure acting on the adjusting means to reduce the displacement of the associated pump when said single control pressure exceeds said counter-pressure, wherein said single control pressure ($p_{Qi}$) is taken off before said throttle in the working pressure line of the respective pump and acts on the associated pilot valve via a control pressure line towards the control position.

2. A control system according to claim 1, wherein each of said throttle is in the form of a constant throttle.

3. A control system according to claim 1, wherein the counter-pressure is at least one of the pressure of a spring and a hydraulic counter-pressure acting on a counter-pressure control chamber of the respective pilot valve.

4. A control system according to claim 1, wherein said counter-pressure is adjustable.

5. A control system according to claim 1, which includes a remote control valve common to all said pilot valves to control a hydraulic counter-pressure.

6. A control system according to claim 5, wherein said remote control valve is in the form of a pressure-limiting valve connected to a counter-pressure control chamber and via a throttle to the control pressure line of each of said pilot valves.

7. A control system according to claim 5, wherein said remote control valve is in the form of a throttle element arranged in the consumer line, and behind said throttle element a branch line leads to the counter-pressure control chamber of each of said pilot valves.

8. A control system according to claim 7, wherein said throttle element is in the form of an adjustable throttle valve.

* * * * *